US006837929B2

(12) United States Patent
Cardinaels

(10) Patent No.: US 6,837,929 B2
(45) Date of Patent: Jan. 4, 2005

(54) METHOD AND DEVICE FOR PROVIDING A LAYER OF COATING MATERIAL ON THE INNER SIDE OF A DISPLAY WINDOW FOR A COLOR DISPLAY TUBE

(75) Inventor: Frans Corneel Cardinaels, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 82 days.

(21) Appl. No.: 10/270,342

(22) Filed: Oct. 11, 2002

(65) Prior Publication Data

US 2003/0087027 A1 May 8, 2003

Related U.S. Application Data

(62) Division of application No. 09/734,079, filed on Dec. 11, 2000, now Pat. No. 6,514,558.

(30) Foreign Application Priority Data

Dec. 10, 1999 (EP) ..... 99204256

(51) Int. Cl.[7] ..... B05C 13/00

(52) U.S. Cl. ..... 118/55; 118/52; 118/318; 118/320; 118/500; 118/501; 427/240; 427/425

(58) Field of Search ..... 118/52, 55, 318, 118/320, 501, 504, 500; 427/240, 425

(56) References Cited

U.S. PATENT DOCUMENTS 3,364,054 A * 1/1968 Weingarten ..... 427/72
3,467,059 A * 9/1969 Korner ..... 118/53
3,672,932 A * 6/1972 D'Augustine ..... 427/72
5,316,785 A * 5/1994 Yanai et al. ..... 427/72
5,660,634 A * 8/1997 Fujiyama et al. ..... 118/319
5,785,759 A * 7/1998 Sago et al. ..... 118/319
5,902,648 A * 5/1999 Naka et al. ..... 427/558
6,103,297 A * 8/2000 Aoki et al. ..... 427/72
6,494,952 B1 * 12/2002 Mann et al. ..... 118/52

FOREIGN PATENT DOCUMENTS

JP 3-230451 A * 10/1991
JP 2000-021307 A * 1/2000

* cited by examiner

*Primary Examiner*—Kirsten C. Jolley
(74) *Attorney, Agent, or Firm*—Aaron Waxler

(57) ABSTRACT

Method and device for providing a layer (6) of a coating material on the inner side (2) of a display window (1) for a color display tube. A drop (3) of a suspension of said coating material is deposited on the inner side of the display window, its axis of symmetry (4) being oriented vertically. Then the display window is rotated around said axis of symmetry, and at the same time, said axis is tilted to a horizontal position. The suspension is thereby distributed on the inner side of the display window. An excess of suspension is collected during the rotation in four collection cups (8) arranged at the comers (7) of the display window, whence it is drained off to a central collection cup (10). Finally, the part of the suspension which remains on the display window is dried by infrared radiation (9). As the suspension is drained from the four collection cups to the central collection cup during the rotation, there is no risk that the suspension may drip from the cups onto the display window. Thus, the rotation can be carried out at such a low velocity that layers having a very homogeneous thickness can be formed.

6 Claims, 2 Drawing Sheets

Figure 1:
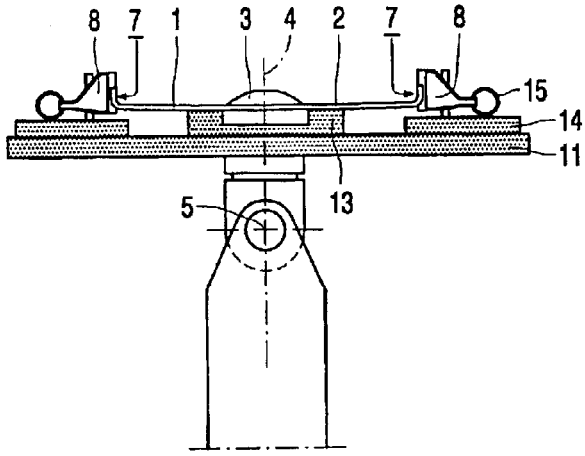

METHOD AND DEVICE FOR PROVIDING A LAYER OF COATING MATERIAL ON THE INNER SIDE OF A DISPLAY WINDOW FOR A COLOR DISPLAY TUBE

This is a divisional of application Ser. No. 09/734,079 filed Dec. 11, 2000, now U.S. Pat. No. 6,514,558.

The invention relates to a method of providing a layer of a coating material on the inner side of a bowl-shaped rectangular display window for a color display tube, in which method a suspension of the coating material is provided on the inner side while the display window is horizontally arranged with its axis of symmetry oriented transversely to the inner side, whereafter the display window is rotated around its axis of symmetry for some time so as to distribute the suspension homogeneously on the inner side, said axis of symmetry being tilted until it is oriented substantially horizontally, during which rotation a part of the suspension provided is drained off the display window near its corners where it is collected in collection cups which are present near the corners during the rotation, and whereafter the suspension which is still present on the inner side of the display window is dried by means of thermal radiation. The invention also relates to a device for performing such a method.

A plurality of layers of a coating material is provided one upon the other on the inner side of a display window of a color display tube. In a color display tube, not only layers of red, green and blue fluorescent material are used but often also layers of a material transmitting only light of a given color or a material transmitting no light at all. After each layer has been provided, a pattern is formed therein. Each provided layer, to which photosensitive components are added specially for this purpose, is exposed in accordance with the pattern to be formed, whereafter the unexposed parts are dissolved in a developer. In display tubes for use in computer monitors, patterns of juxtaposed red, green and blue fluorescent dots are formed in the layers of fluorescent material, and patterns of juxtaposed red, green and blue fluorescent stripes are formed in display tubes for use in television apparatuses. A black matrix—a black layer with windows at the area of the fluorescent dots or stripes—may be formed in the layer of opaque material so that the contrast of images to be displayed can be enhanced. Patterns of color filters may be formed in the layers of a material transmitting only light of a given color, so that a better color rendition can be obtained.

During provision of the suspension, in which the display window may be stationary or rotate about its axis of symmetry oriented transversely to the inner side, this suspension is provided in excess. During the rotation, the suspension is homogeneously distributed on the inner side of the display window. This is effected by means of centrifugal forces and also by gravitational force when the axis of symmetry directed transversely to the inner side of the display window is in a horizontal position. An excess of suspension is drained off the display window near its corners. In these corners, the suspension is collected in collection cups which are present near the corners during the rotation, whereafter it may be used for coating other display windows. The suspension which is still present on the inner side of the display window is dried by means of thermal radiation, after which the desired coating is obtained.

A method of the type described in the opening paragraph is known from NL-A-6 601 802, in which method the part of the suspension which is drained off the display window near its corners during the rotation is collected in closed collection cups. After a layer has been provided, the collection cups are emptied.

When a layer is provided by means of this method on a pattern which is already present on the inner side of the display window, a layer which does not have a homogeneous thickness may be formed. A layer may then be formed with a pattern of thickness differences caused by interaction between the suspension moving during the rotation with the pattern which is already present. This pattern of thickness differences may be visible when displaying images on display tubes having such display windows. In display tubes having display windows with a pattern of juxtaposed fluorescent dots, this is visible in the form of a 60° cross, and in display tubes having display windows with a pattern of juxtaposed fluorescent stripes, this is visible in the form of a north-south line. Such image errors are unwanted.

It is an object of the invention to provide a method allowing manufacture of a display window in which the occurrence of these image errors is prevented when images are displayed on display tubes equipped with such a display window. To this end, the method is characterized in that, during the rotation, the part of the suspension collected in the collection cups near the corners of the display window is further drained from these cups to a co-rotating central collection cup.

Said image errors, 60° cross and north-south line, may be suppressed by performing the rotation at a low velocity during provision of the layer of coating material. However, when the velocity decreases, there is the risk in the known method that the suspension in the collection cups drips onto the provided layer, particularly when the axis of symmetry oriented transversely to the display window is in a horizontal position at the end of the rotation. Such drops on the layer may render a display window unusable. Due to the measure according to the invention, it is prevented that suspension drips from the collection cups onto the display window during the rotation so that the rotation can be performed at such a low velocity that layers can be provided one on top of the other without said patterns of thickness differences being formed. Said image errors, 60° cross and north-south line, cannot occur during the display of images in display tubes comprising display windows manufactured in this manner.

It is to be noted that a method of the type described in the opening paragraph is known from U.S. Pat. No. 3,467,059, in which method the part of the provided suspension drained off the display window near its corners is not collected in collection cups but in an annular collection window co-rotating with the display window, from which collection window the suspension is guided to a stationary annular collection basin arranged outside the window. Such a system for draining the excess of suspension is unsatisfactory, particularly at low rotation velocities. The suspension is distributed on the collection window from where it may easily drip onto the display window, particularly when the axis of symmetry oriented transversely to the inner side of the display window is in a horizontal position. There is no risk of dripping in the method according to the invention.

The part of the suspension which is collected in the collection cups can be transported to the central collection cup by means of, for example, pumps. A simpler method is, however, obtained when the part of the suspension collected in the collection cups is drained from these cups to a central pipe through which it is drained to the central collection cup by means of centrifugal forces generated by the rotation.

At low rotation velocities, particularly when the axis of symmetry oriented transversely to the inner side of the display window is in a horizontal position, the gravitational force on the suspension in the central pipe may be larger than the centrifugal force. Consequently, a part of the suspension which is already present in the pipe might flow back into the collection cups. This increases the risk of suspension dripping onto the display window. When the method is being carried out, it is therefore preferably ensured that the part of the suspension collected in the collection cups is drained from these collection cups to the central pipe in such a way that, during the rotation, the suspension cannot flow back into the collection cups. For the same reason, the risk of dripping is further reduced by ensuring that the part of the suspension collected in the collection cups is drained from the central pipe to the central collection cup in such a way that, during the rotation, the suspension cannot flow back into the central pipe.

The invention also relates to a device for providing a layer of a coating material on the inner side of a bowl-shaped rectangular display window of a color display tube, which device comprises a turntable which is rotatable about an axis of rotation oriented transversely to the turntable and tiltable about a tilt axis oriented transversely to the axis of rotation, said turntable having a holder for securing the display window on the turntable in such a way that its axis of symmetry oriented transversely to the inner side coincides with the axis of rotation of the turntable and of four collection cups which are secured on the turntable at the area of the corners of a display window to be arranged on the turntable, so that, during operation of the device, a part of a suspension provided on the inner side of the display window and drained off the display window during the rotation can be collected by said collection cups.

To ensure that the rotation can be performed at a low velocity when coating the inner side of the display window without drops from the collection cups falling on the display window, this device according to the invention is characterized in that the turntable is further provided with a central collection cup and with means for draining the part of the suspension collected in the collection cups near the corners of the display window to the central collection cup during operation of the device.

The part of the suspension collected in the collection cups can be transported to the central collection cup by means of, for example, pumps, but a simpler device is obtained when the means for draining suspension from the collection cups to the central collection cup comprises a hose secured to the turntable, which hose is bent in accordance with a circle having its center on the axis of rotation and being located outside the four collection cups, the hose being circumferentially coupled to the four collection cups and both its ends being coupled to the central collection cup arranged between these two ends.

Both ends of the hose are preferably coupled to the central collection cup by means of two connection pipes intersecting a wall of the central collection cup, which connection pipes are slid into the ends of the hose outside the central collection cup and project through some distance into the wall within the central collection cup. It is thereby prevented that, during the rotation, suspension can flow back from the central collection cup to the hose.

Furthermore, the hose is preferably coupled circumferentially to the four collection cups by means of drain pipes formed on the collection cups and projecting through some distance into the hose whose wall is to this end provided with four apertures narrowly enclosing the drain pipes. It is thereby also prevented that suspension flows back from the hose into the collection cups.

These and other aspects of the invention are apparent from and will be elucidated with reference to the embodiments described hereinafter.

Figure 2:
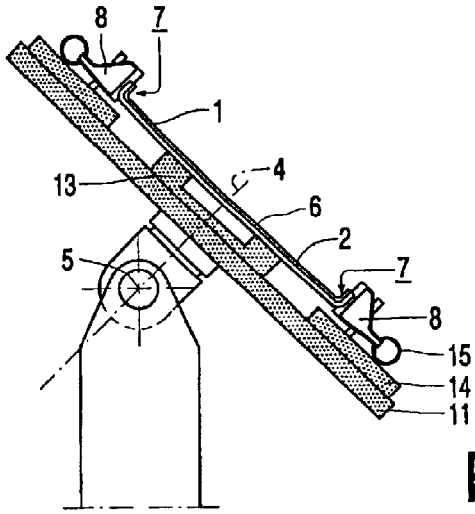
Figure 3:
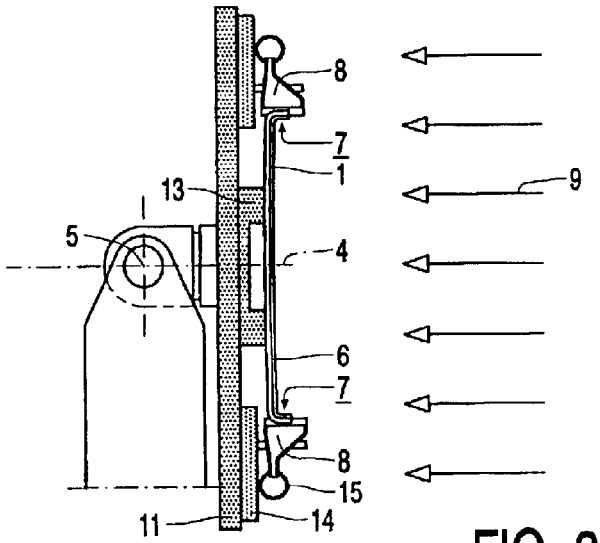
Figure 4:
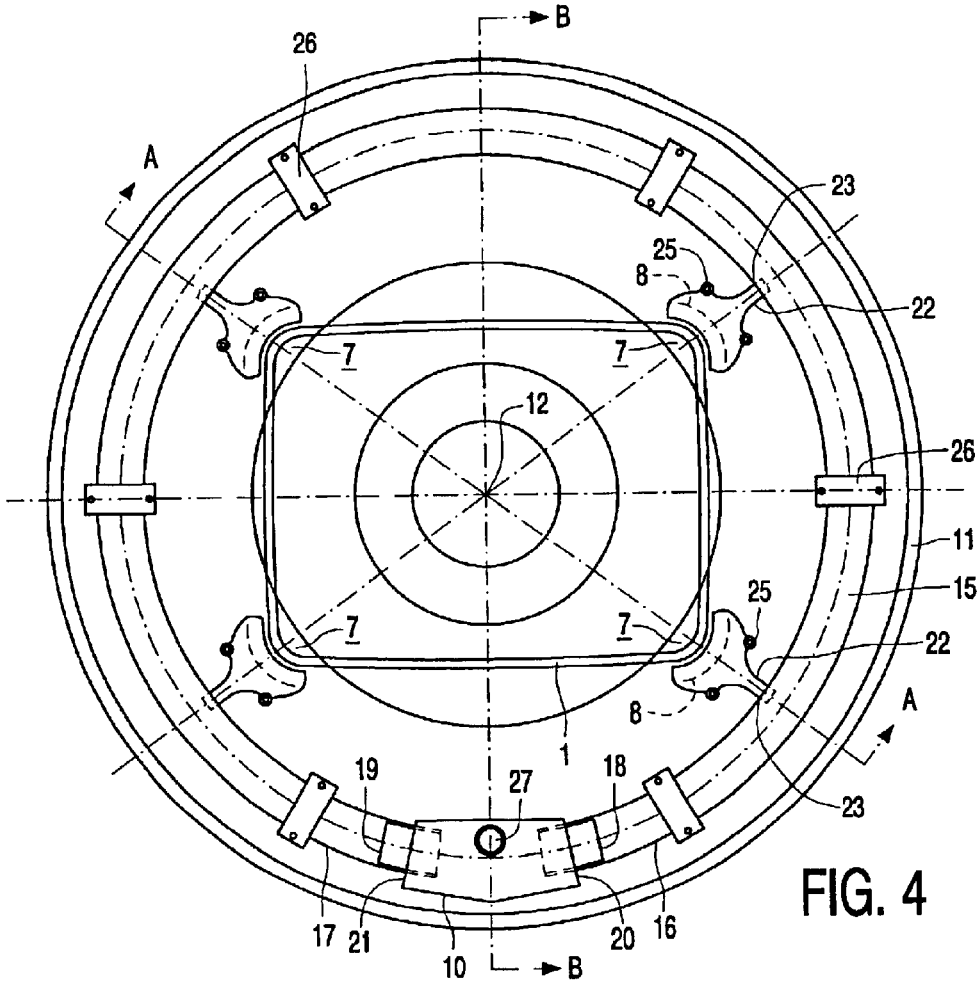
Figure 5:
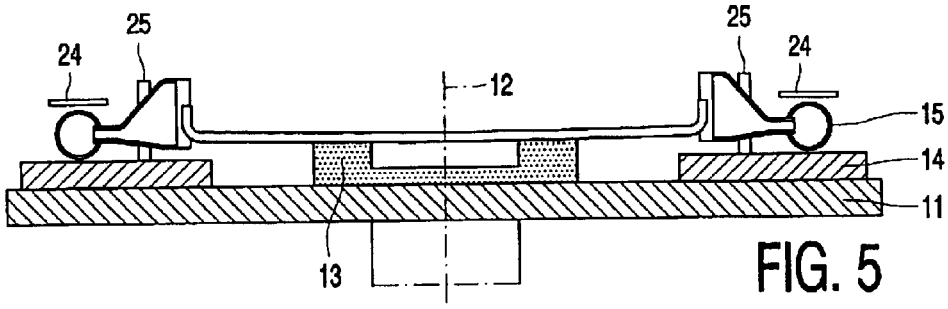
Figure 6:
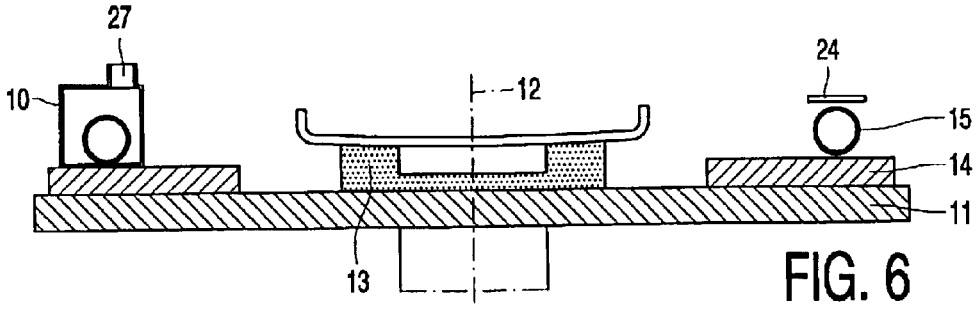

In the drawings:

FIGS. 1 to 3 are diagrammatic cross-sections of some stages of performing the method according to the invention by means of the device according to the invention, FIG. 4 is a diagrammatic plan view of a relevant part of the device according to the invention, and FIGS. 5 and 6 show diagrammatically the cross-sections taken on the lines A—A and B—B in FIG. 4.

FIGS. 1 to 3 are diagrammatic cross-sections of some stages of performing the method of providing a layer of a coating material on the inner side 2 of a bowl-shaped rectangular display window 1 for a color display tube. A suspension 3 of the coating material is provided on the inner side 2, while, as shown in FIG. 1, the display window 1 takes up a horizontal position with respect to its axis of symmetry 4 oriented transversely to the inner side. Subsequently, the display window 1 is rotated about its axis of symmetry 4 for some time so as to distribute the suspension homogeneously on the inner side 2. As is shown in FIGS. 2 and 3, the axis of symmetry 4 is tilted about a tilt axis 5 until it is directed substantially horizontally. A layer 6 is thus formed on the inner side. During the rotation, a part of the provided suspension 4 is drained off the display window 1 near its corners 7 where it is collected in collection cups 8 which are present near the corners 7 during the rotation. Finally, the suspension layer 6 which is still present on the inner side of the display window is dried by means of thermal radiation, denoted by arrows 9.

A plurality of layers of a coating material such as the layer 5 is provided one upon the other on the inner side 2 of a display window 1 for a color display tube. After the provision of each layer, a pattern is formed therein. Each provided layer, to which photosensitive components are added specially for the purpose, is exposed in accordance with the pattern to be formed, whereafter the unexposed parts are dissolved in a developer. In this example, an approximately 1 $\mu$m thick layer of an opaque material, here graphite, is first provided on the inner side of a display window having a diameter of approximately 40 cm. A pattern of apertures having a diameter of approximately 140 $\mu$m is formed in this layer. A red, a green and a blue fluorescent layer are provided on this first layer in which patterns of juxtaposed red, green and blue fluorescent dots are formed at the area of the apertures in the black matrix layer. In this example, about 60 cc of a suspension is provided for each of these layers on the display window, whereafter the window is rotated at about 60 revolutions per minute for 4 minutes. During this period, the window is tilted about the tilt axis 5 until the axis of symmetry 4 is substantially horizontal. Subsequently, the layers are dried by means of radiation 9. About 12 $\mu$m thick layers of fluorescent materials are formed in this way.

When the suspension is being provided, in which the display window rotates in this example (the suspension may be alternatively provided on a stationary window), this suspension is provided in excess. During the rotation, the suspension 3 is homogeneously distributed on the inner side 2 of the display window 1, during which the layer 6 is formed. This is effected by centrifugal forces and also by gravitational force when the axis of symmetry 4 oriented transversely to the inner side 2 of the display window 1 is in a horizontal position. An excess of suspension is drained off the display window near the corners 7. During the rotation, the excess of suspension is collected in collection cups 8 near the corners 7. The excess of suspension may be used for coating other display windows.

A layer 6 may be formed on the display window mentioned in this example with a pattern of thickness differences obtained by interaction of the suspension 3 moving during the rotation with a pattern which is already present. This may be interaction with the pattern of the black matrix layer or with the pattern of an underlying layer of fluorescent material. This pattern of thickness differences may be visible when displaying images on display tubes having such display windows. In display tubes of the type as mentioned in this example, with a pattern of juxtaposed fluorescent dots, this may be visible in the form of a 60° cross. Such image errors can be avoided by performing the rotation at a low velocity. This is possible because the part of the suspension which is collected in the collection cups 8 near the corners 7 of the display window 1 is drained from these cups to a co-rotating central collection cup 10 shown in FIG. 4. If the excess of suspension were not drained, the suspension in the collection cups could drip on the provided layer, particularly when the axis of symmetry oriented transversely to the display window is in a horizontal position at the end of the rotation. Such drops on the layer may render a display window unusable. Display tubes having a display window made in the manner as described in the above example do not show this image error.

FIG. 4 is a plan view of a part of the device for providing the layer 5 of coating material on the inner side 2 of the display window 1, and FIGS. 5 and 6 are cross-sections taken on the lines A—A and B—B of this device in FIG. 4. The device comprises a turntable 11 which is rotatable about an axis of rotation 12 oriented transversely to the turntable 11 and is tiltable about a tilt axis 5 oriented transversely to the axis of rotation 12 and shown in FIGS. 1 to 3. The turntable 11 has a holder 13, here a conventional vacuum holder, for securing the display window 1 on the turntable 11 in such a way that its axis of symmetry 4 oriented transversely to the inner side coincides with the axis of rotation 12 of the turntable 11. Moreover, the device comprises four collection cups 8 which are secured on the turntable 11 at the area of the corners 7 of a display window 1 to be arranged on the turntable 11 so that, during operation of the device, a part of a suspension 3 provided on the inner side 2 of the display window 1 and drained off the display window during the rotation can be collected by these cups. The collection cups are secured to a ring 14 which is detachably connected to the turntable.

The central collection cup 10 and means 15 for draining the part of the suspension collected in the collection cups 8 near the corners 7 of the display window 1 to the central collection cup are also arranged on the ring 14.

During operation, the part of the suspension 3 collected in the collection cups 8 is transported to the central collection cup 10 by means of centrifugal forces generated by the rotation. To this end, a hose 15 which is bent in accordance with a circle having its center on the axis of rotation 12 and being located outside the four collection cups 8 is secured to the turntable 11. The hose 15 is circumferentially coupled to the four collection cups 8 and both its ends 16 and 17 are coupled to the central collection cup 10 which is arranged between these two ends.

The two ends 16 and 17 of the hose 15 are coupled to the central collection cup 10 by means of the two connection pipes 18 and 19 which intersect a wall 20, 21 of the central collection cup 10, which connection pipes 18, 19 are slid into the ends 16, 17 of the hose 15 outside the central collection cup and project through some distance into the wall 20, 21 within the central collection cup 10. It is thereby prevented that, during the rotation, suspension can flow back from the central collection cup 10 to the hose 15.

The hose 15 is circumferentially coupled to the four collection cups 8 by means of drain pipes 22 formed on the collection cups 8 and projecting through some distance into the hose 15 whose wall is to this end provided with four apertures 23 narrowly enclosing the drain pipes 22. Flow back of suspension from the hose 15 to the collection cups 8 is thus also prevented.

To prevent heating of the suspension in the hose when the layer 6 is dried by means of radiation 9, a radiation shield 24, shown in FIGS. 5 and 6 only, shielding the hose 15 from the radiation 9 to be used for drying the suspension is arranged in front of the side of the hose 15 remote from the turntable 11. The collection cups 8 with supports 25 secured thereto, the central collection cup 10, the circularly bent hose 15 with brackets 26 and the radiation shield 24 are detachably secured to the ring 14 which in its turn is detachably secured to the turntable 11. The components which come in contact with the suspension can thus be easily released and subsequently cleaned. The central collection cup 10 has an opening 27 through which it can be emptied.

What is claimed is:

1. A device for providing a layer of a coating material on the inner side of a bowl-shaped rectangular display window of a color display tube, which device comprises a turntable which is rotatable about an axis of rotation oriented transversely to the turntable and tiltable about a tilt axis oriented transversely to the axis of rotation, said turntable having a holder for securing the display window on the turntable in such a way that its axis of symmetry oriented transversely to the inner side coincides with the axis of rotation of the turntable and of four collection cups which are secured on the turntable at the area of the corners of a display window to be arranged on the turntable, so that, during operation of the device, a part of a suspension provided on the inner side of the display window and drained off the display window during the rotation can be collected by said collection cups, characterized in that the turntable is further provided with a co-rotating central collection cup and with means for draining the part of the suspension collected in the collection cups near the corners of the display window to the central collection cup during operation of the device.

2. A device as claimed in claim 1, characterized in that the means for draining suspension from the collection cups to the central collection cup comprises a hose secured to the turntable, which hose is bent in accordance with a circle having its center on the axis of rotation and being located outside the four collection cups, the hose being circumferentially coupled to the four collection cups and both its ends being coupled to the central collection cup arranged between these two ends.

3. A device as claimed in claim 2, characterized in that the two ends of the hose are coupled to the central collection cup by means of two connection pipes intersecting a wall of the central collection cup, which connection pipes are slid into the ends of the hose outside the central collection cup and project through some distance into the wall within the central collection cup.

4. A device as claimed in claim 2, characterized in that the hose is circumferentially coupled to the four collection cups by means of drain pipes formed on the collection cups and projecting through some distance into the hose whose wall is to this end provided with four apertures narrowly enclosing the drain pipes.

5. A device as claimed in claim 2, characterized in that a radiation shield shielding the hose from the radiation to be used for drying the suspension is arranged in front of the side of the hose remote from the turntable.

6. A device as claimed in claim 5, characterized in that the collection cups, the central collection cup, the circularly bent hose and the radiation shield are detachably secured to a ring which may be secured to the turntable.

* * * * *